United States Patent [19]

Wilson

[11] Patent Number: 4,520,928

[45] Date of Patent: Jun. 4, 1985

[54] NESTABLE/STACKABLE CONTAINERS FOR BAKERY GOODS AND THE LIKE

[76] Inventor: James D. Wilson, 421 Vista Suerte, Newport Beach, Calif. 92660

[21] Appl. No.: 573,695

[22] Filed: Jan. 25, 1984

Related U.S. Application Data

[63] Continuation-in-part of Ser. No. 546,822, Oct. 31, 1983, abandoned.

[51] Int. Cl.[3] ..... B65D 21/04

[52] U.S. Cl. ..... 206/505; 206/507

[58] Field of Search ..... 206/505, 507

[56] References Cited

U.S. PATENT DOCUMENTS

| | | | |
|---|---|---|---|
| 3,022,900 | 2/1962 | Averill | 206/505 |
| 3,398,840 | 8/1968 | Wilson | 206/505 |
| 3,405,810 | 10/1968 | Rogus | 206/507 |
| 4,000,817 | 1/1977 | Sanders et al. | 206/505 |
| 4,102,453 | 7/1978 | Carroll et al. | 206/507 |
| 4,308,954 | 1/1982 | Wilson | 206/505 |

FOREIGN PATENT DOCUMENTS

| | | | |
|---|---|---|---|
| 856044 | 11/1970 | Canada | 206/507 |
| 2024161 | 1/1980 | United Kingdom | 206/507 |

*Primary Examiner*—George E. Lowrance
*Attorney, Agent, or Firm*—Keith D. Beecher

[57] ABSTRACT

A nestable/stackable container for transporting, storing and displaying bakery goods, and other products, which may be stacked on top of like containers at different stacking levels for accommodating products of different heights, and which may be nested down into like containers when empty, all of the above being accomplished without any need to rotate the individual containers.

4 Claims, 7 Drawing Figures

NESTABLE/STACKABLE CONTAINERS FOR BAKERY GOODS AND THE LIKE

This application is a continuation-in-part of Copending Application Ser. No. 546,822 filed Oct. 31, 1983, now abandoned, in the name of the present inventor.

BACKGROUND OF THE INVENTION

One type of bakery goods distribution system uses nestable/stackable containers such as described in U.S. Pat. Nos. 4,308,954 and 4,334,616 which issued in the name of the present inventor. The nestable/stackable containers described in the patents may be loaded with bakery goods at the bakery and stacked on top of one another on appropriate dollies. The stacks of loaded containers may then be transported to the depots and/or to the retail outlets on appropriate trucks. Upon arrival at the retail markets, the stacks of loaded containers may be rolled on the dollies to appropriate positions on the floor of the market. The products in the containers may then be displayed at the various positions and made available for purchase while still in the containers. When the containers are empty, they may be nested down into one another for space conservation purposes, and returned to the bakery.

DETAILED DESCRIPTION OF THE ILLUSTRATED EMBODIMENT

Figure 1:
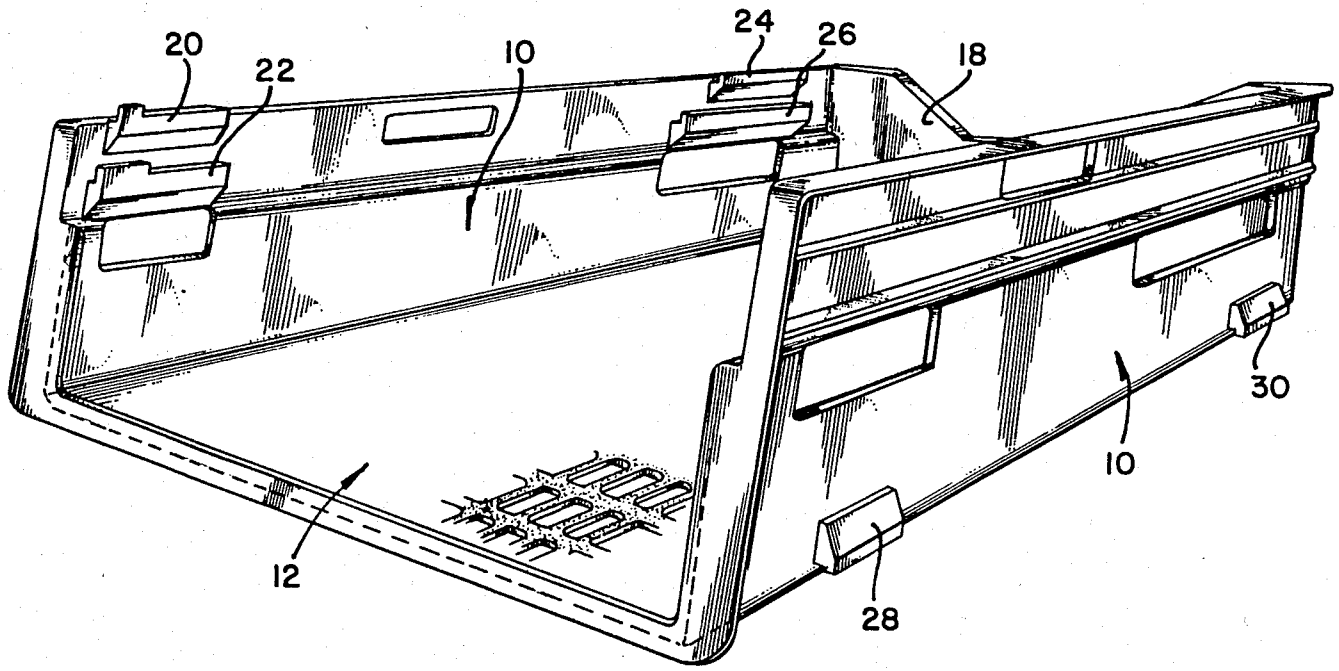
FIG. 1 is a perspective view of a nestable/stackable container representing one embodiment of the invention.

The nestable/stackable container shown in FIG. 1 is designated 10. Container 10 has an open front end to facilitate the removal of products. The container 10 has a bottom 12. The container 10 may be molded as a single integral unit and formed, for example, of an appropriate plastic material such as polypropylene by injection molding techniques.

Each side of container 10 is provided with two upper integral stacking lugs such as lugs 20, 22, on each side, and two intermediate stacking lugs, such as lugs 24 and 26 on each side. The forward portion of each of the stacking lugs adjacent to the open front of the container, such as lugs 20 and 22, has increased height, as shown, to define a shoulder with the rear portion thereof. Likewise, each side of the container 10 is equipped with two lower stacking feet, such as feet 28, 30.

The container of FIG. 1 may be stacked on other like containers at a variety of stacking levels, as mentioned above. For example, in the top stacking position, the lower stacking feet 28 and 30 are supported by the upper stacking lugs 20 and 24, and their counterparts on the other side of the container. To lower the container down to the intermediate stacking position on the like container, the front end of the container is lifted, so that lower stacking feet at the forward end of the container, such as foot 28, may be pulled clear of the forward end of upper stacking lugs at the forward end of the container, such as lug 20. The upper container is then pulled forwardly until the lower stacking feet at the rear end of the container, such as foot 30, drop down from the upper stacking lugs at the rear end of the container, such as lug 24 to the intermediate lugs 26. The upper container may then be pushed back until the lower stacking feet at the front end of the container, such as foot 28, are supported on the rear ends of the intermediate stacking lugs at the front end of the container, such as lug 22. In each instance, the lower stacking fee are retained in position on the stacking lugs by the shoulders described above.

Then, to nest an upper container 10 into a lower container, the upper container is then again pulled up to lift the lower stacking feet at the front end of the container, such as foot 28 off the intermediate stacking lugs at the front end of the container, such as lug 22, and is pulled forward until the rear end of the container drops to the bottom of the lower like container. The upper container is then moved back so that it occupies its nesting position in vertical alignment with the lower container.

Figure 2:
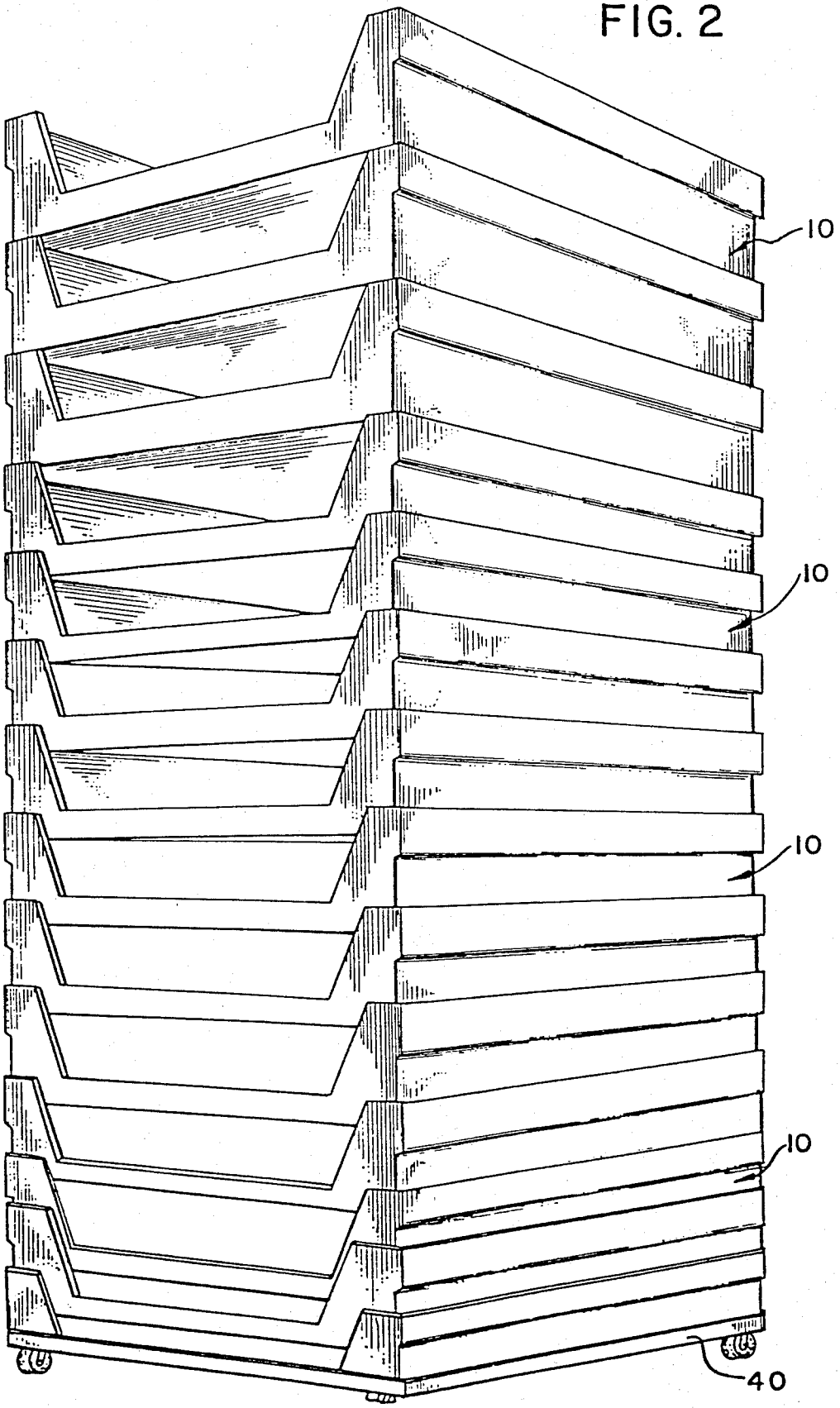
FIG. 2 is a perspective representation of a plurality of the containers of FIG. 1 stacked on top of one another at different stacking heights, in a stack supported on a dolly, so as to accommodate bakery products of different heights.

The stack shown in FIG. 2 shows the containers 10 of FIG. 1 stacked on top of one another in either of two stacking positions, with the upper three containers being stacked at the top position, and the next eight containers being stacked at the lower position. Then, the next six containers are stacked in their nested position, with the lowermost two containers again being stacked at the uppermost position. The containers in the stack of FIG. 2 are supported on a wheeled dolly 40.

Accordingly, the containers in the stack of FIG. 2 may be loaded with different heights of bakery products at the bakery, and then wheeled to a loading dock. At the loading dock, the loaded stacks may be wheeled onto a route truck and transported by the route truck to the individual retail markets. At the markets the entire stacks may be removed and wheeled on dollies, such as dolly 41, into the markets for the ultimate display of the products at the actual points of purchase.

When the containers of bakery goods are delivered to the retail markets loaded on dollies 40, they may be wheeled from the route trucks into the market, and positioned at appropriate locations in the market for selection and sale of the merchandise.

Figure 3:
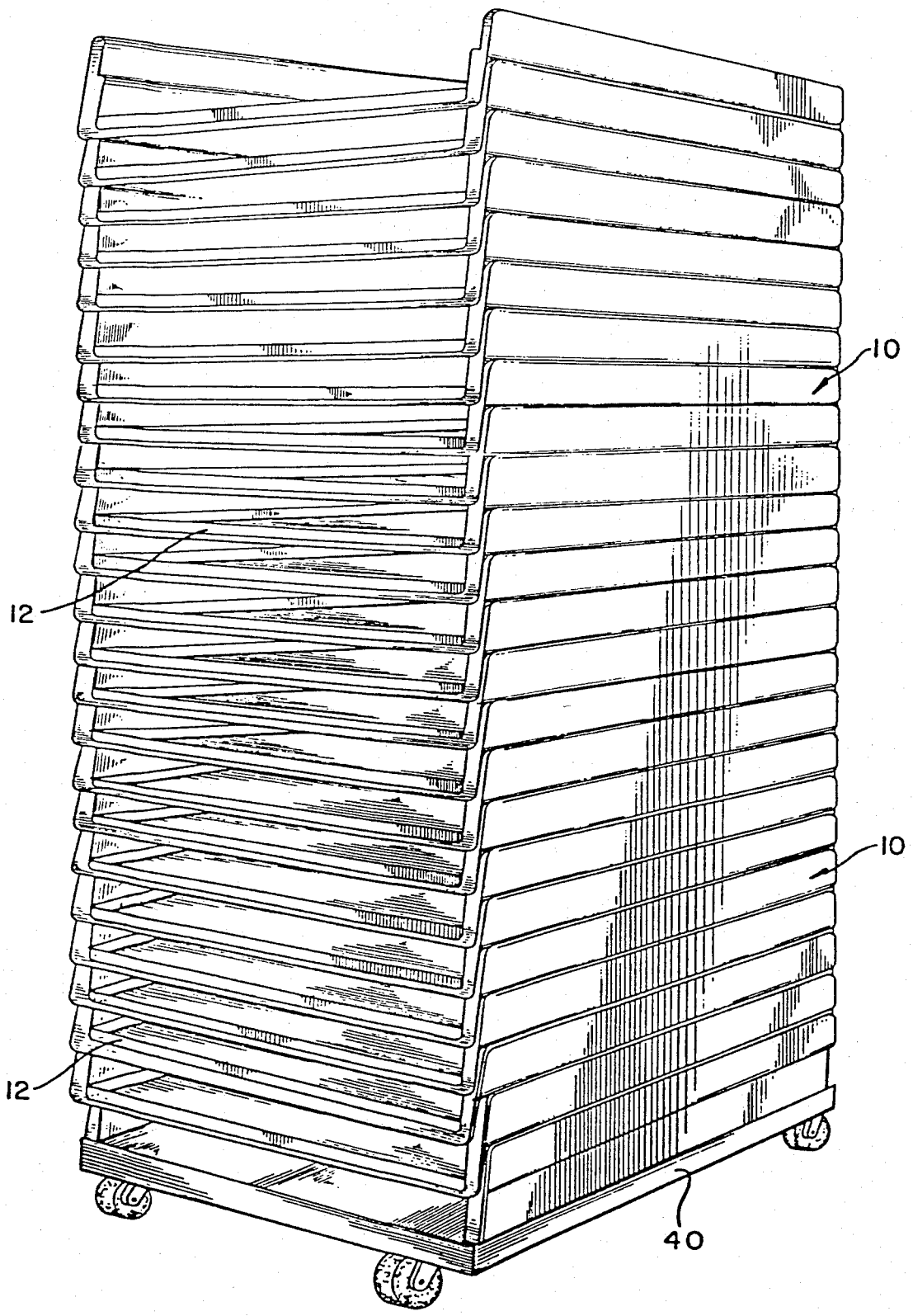
FIG. 3 is a perspective view of a stack of the nestable/stackable containers of FIG. 1, in a nested position, when empty, for return to the bakery as viewed from the open end.

When the containers transported by the route trucks to the individual markets are empty, they may all be stacked in a nested condition on the dollies, such as the dolly 40 of FIG. 3 as a compact stack, so as to be returned to the bakery with an efficient utilization of the available space in the route trucks.

Figure 4:
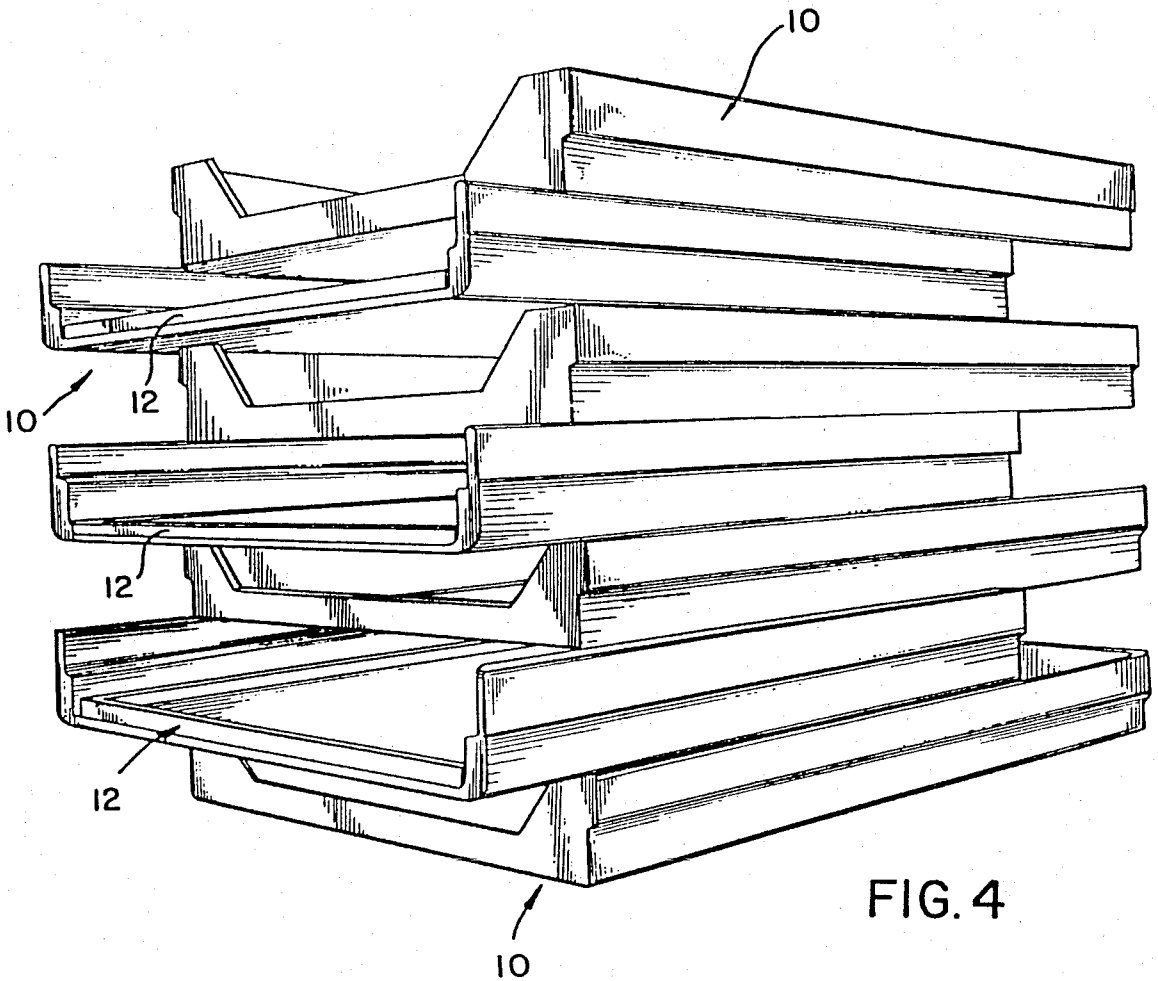
FIG. 4 is a perspective view of the nestable/stackable containers of FIG. 1 in a zigzag display in the market for convenient selection of the products.

As shown in FIG. 4, the various containers may be stacked in the market in a zigzag display, for the convenient selection of the products by the purchasers.

Figure 5:
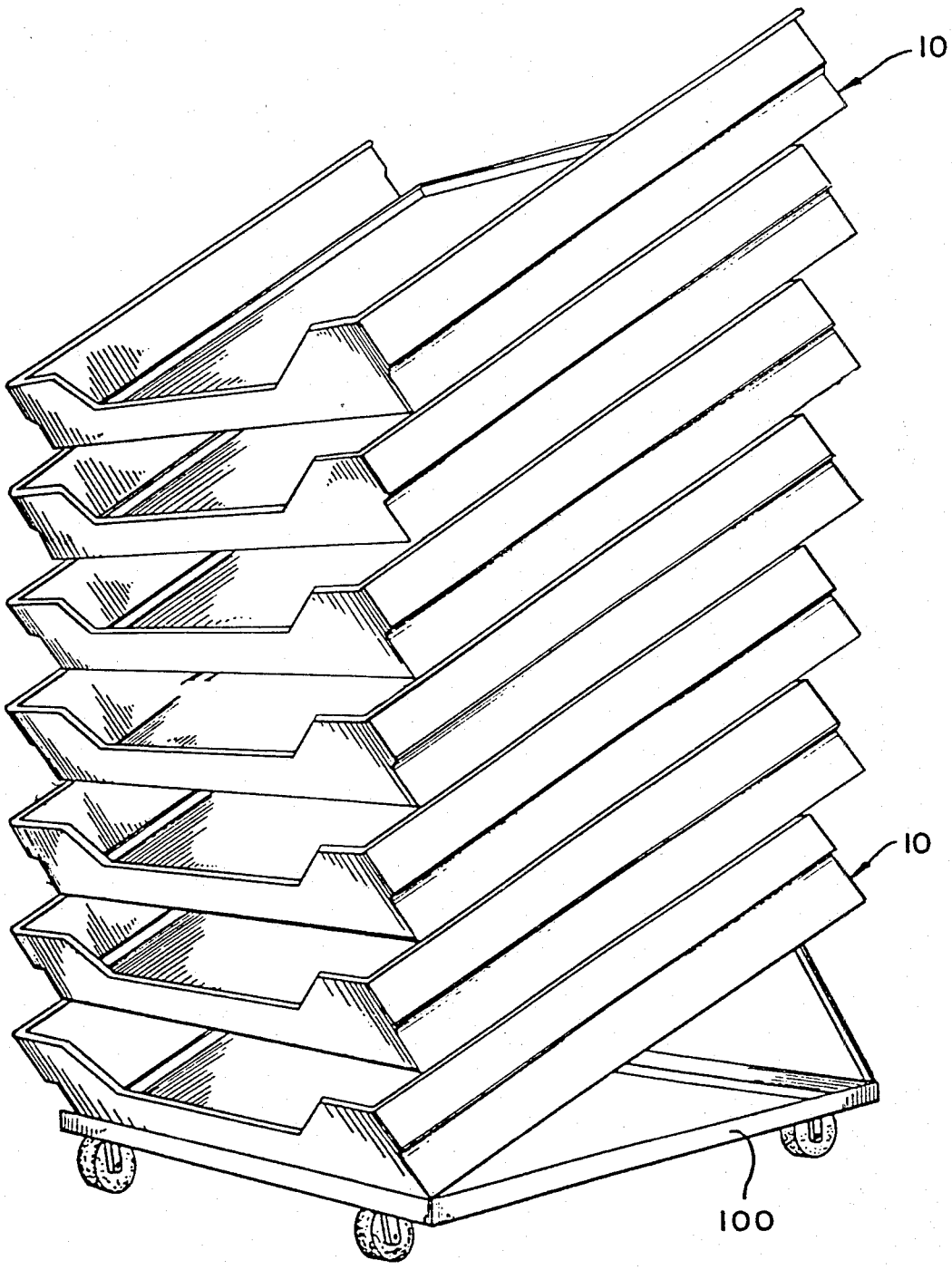
FIG. 5 is a perspective view of the nestable/stackable containers of FIG. 1, illustrating the manner in which the containers may be loaded on a dolly in the retail market for a gravity feed display of the merchandise.

The containers delivered to the retail markets may be supported on dollies, such as dolly 100 of FIG. 5. The containers may be supported by dolly 100 in an upright stack, but with each of the containers being inclined, as shown, so that merchandise is fed by gravity to the end of each container for convenient selection by the purchasers.

Figure 6:
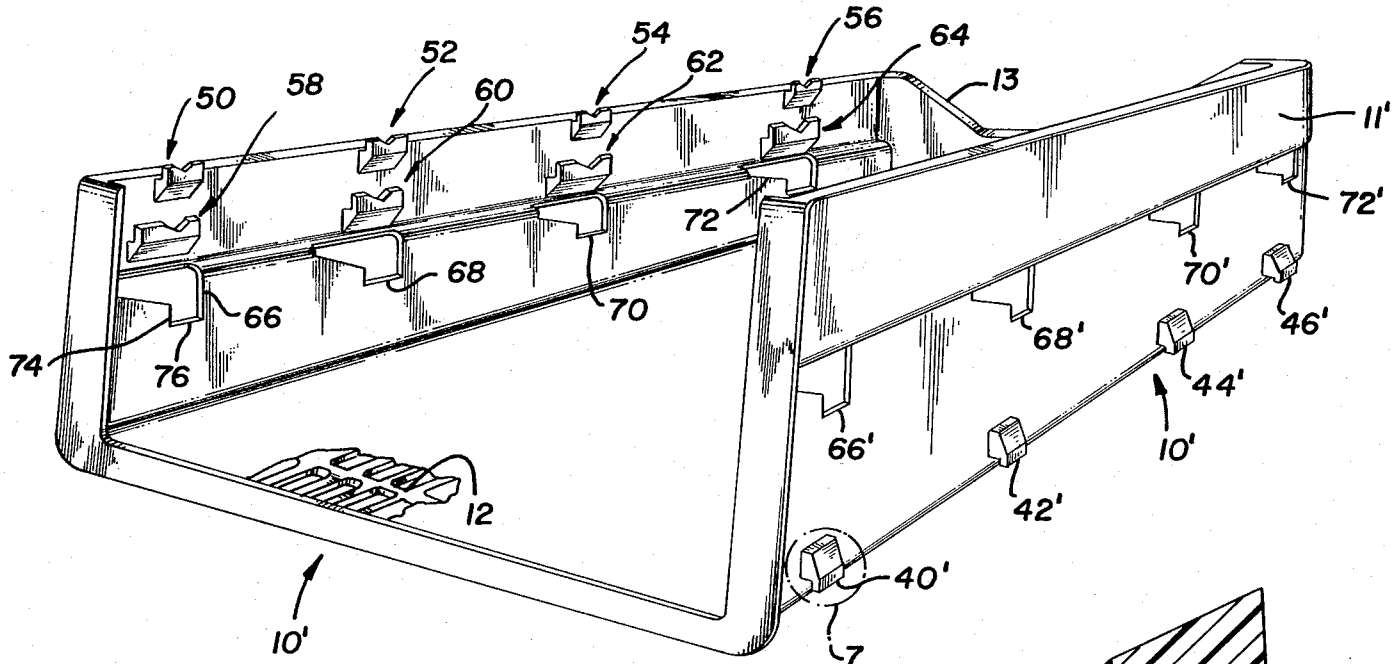
FIG. 6 is a perspective view of a modified version of the container of FIG. 1.

The nestable/stackable container of FIG. 6 is designated 10' and, as mentioned above, is a modified version of container 10 of FIG. 1. The container 10', like container 10, has sides 11, 11', a partial rear wall 13, an open front end, and a bottom 12', with the sides, bottom and rear wall all being formed of molded plastic construction integral with one another, as was the case with container 10. Bottom 12' may be like the bottom 12 of container 10 shown in FIG. 1, or it may be solid or ribbed, if so desired. The rear wall 13 may extend, for example, to a height up to one-third of the height of the sides of the container.

Container 10' of FIG. 6 has a number of upper stacking lugs 50, 52, 54 and 56 formed on the inner surface of side wall 11 at its upper edge, and it has a corresponding number of upper stacking lugs (not shown) formed on the inner surface of the other side 11', at its upper edge, with all of the upper stacking lugs being of equal size.

Container 10' also has a number of intermediate stacking lugs 58, 60, 62 and 64 formed on the inner surface of side 11, displaced downwardly from and under corresponding ones of the upper stacking lugs; and the container has a corresponding number of intermediate stacking lugs formed on the inner surface of the other side 11', displaced downwardly from and positioned under the corresponding upper stacking lugs on that side. The intermediate stacking lugs 58, 60, 62 and 64 on side 11, and the corresponding intermediate stacking lugs on the other side 11', are all longer than the corresponding upper stacking lugs, so that each of the intermediate stacking lugs extends beyond the corresponding upper stacking lugs towards the front of the container.

Container 10' has a number of lower stacking feet 40', 42', 44' and 46' formed on the lower edge of side 11' at its outer surface, and it has a corresponding number of lower stacking feet (not shown) formed on the outer surface of the lower edge of the opposite side 11. Each of the lower stacking feet has the shape shown in FIG. 7, which is a sectional view taken from the rear of stacking foot 40' along the line 7—7 of FIG. 6.

Figure 7:
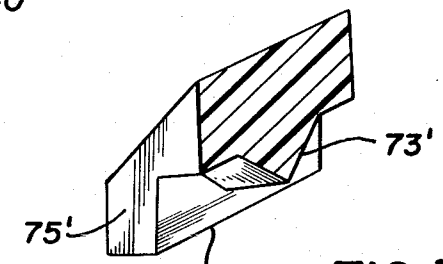
FIG. 7 is an inner view of one of the stacking feet of the container of FIG. 6.

As shown in FIG. 7, each of the lower stacking feet is provided with a V-shaped section 73' at its lower edge, which is received in a V-shaped notch of the corresponding upper or intermediate stacking lug, the V-shaped notches in the stacking lugs being shown in FIG. 6.

To stack the container 10' of FIG. 6 in a top position on a like container, the lower stacking feet, such as feet 40', 42', 44' and 46' of container 10' are placed on the corresponding upper stacking lugs, such as lugs 50, 52, 54 and 56 of the like container. The lower stacking feet will center themselves on the upper stacking lugs of the like container as each V-shaped section 73' of each lower stacking foot engages a corresponding V-shaped notch in the corresponding upper stacking lug, so that the upper container is kept from longitudinally sliding back or forth on the lower container. The front section 75' of each lower stacking foot extends down over the inner face of the corresponding stacking lug to hold the containers against mutual sideways motion with respect to one another. Accordingly, the upper container is firmly held in vertical alignment with the lower container in an upper stacking position.

To stack the two containers on one another in an intermediate stacking position, the upper container is pushed slightly towards the front of the lower container, so that the lower stacking feet, such as feet 40', 42', 44' and 46' of the upper container are displaced slightly to the front of the corresponding responding upper stacking lugs, such as lugs 50, 52, 54 and 56, of the lower container. The intermediate stacking lugs, such as lugs 58, 62 and 64, and their counterparts on the other side of the container, extend to the front of the corresponding upper stacking lugs, so that the lower stacking feet of the upper container will drop onto the intermediate stacking lugs 58, 60 and 64 of the lower container, and on their counterparts on the other side of the lower container.

Then, as the upper container is pushed slightly backward respect to the lower container the V-shaped sections of the lower stacking feet of the upper container will engage the V-shaped notches in the intermediate stacking lugs of the lower container. The upper container will now be held firmly in an intermediate stacking position with respect to the lower container and in vertical alignment with the lower container, and in the same manner as it was held in the upper stacking position, and effectively locked against longitudinal back or forth movement with respect to the lower container, and against lateral movement with respect thereto.

In order to nest the upper container in the lower container from either the upper or intermediate stacking positions, the upper container is pulled towards the front end of the lower container until its lower stacking feet are freed from the stacking lugs of the lower container and fall into the cut-outs 66, 68, 70, 72 and 66', 68', 70' and 72' of the lower container. For this action, the forward left-hand stacking foot of the upper container, for example, moves into cut-out 66 and slides down the inclined edge 74 of the cut-out to a position engaging the lower edge 76 of the cut-out. The other stacking feet of the upper container cooperate accordingly with the corresponding cut-outs of the lower container.

The result is that the upper container is nested into the lower container in vertical alignment with the lower container. The upper and lower containers are firmly held in their nested position until released by raising the upper container and moving its stacking feet forwardly up the inclines of the cut-outs of the lower container until the stacking feet are displaced from the stacking lugs of the lower container, so that the upper container may be moved up and out of the lower container.

Container 10' may also be stacked in the zigzag stack of FIG. 4, or in the gravity feed stack of FIG. 5.

The invention provides, therefore, improved nestable/stackable containers which are intended particularly for use in a bakery distribution system, but which have general utility.

It will be appreciated that while particular embodiments of the invention have been shown and described, modifications may be made. It is intended in the claims to cover all modifications which come within the true spirit and scope of the invention.

What is claimed is:

1. A nestable/stackable container formed of molded plastic material and intended to be nested in other like containers and stacked on other like containers at three different levels, said container having first and second side walls, each of said side walls having a plurality of discrete integral upper stacking lugs formed on the inner surface thereof at spaced positions along the upper edge thereof, and each of said side walls having a plurality of discrete integral lower stacking feet formed on the outer surface thereof at spaced positions along the lower edge thereof, the lower stacking feet being positioned to be received on the upper stacking lugs of a like container when the two containers are stacked on one another at a first vertically aligned stacking level with the front and rear ends of both containers facing the same directions, each of said side walls having a plurality of further discrete intermediate integral stacking lugs formed on the inner surface thereof under respective ones of said upper stacking lugs and extending beyond the respective ends of the corresponding upper stacking lugs by a predetermined amount to receive the lower stacking feet of a like container when the containers are stacked on one another in a second vertically aligned stacking level with the front and rear ends of both containers facing in the same directions; and each of the side walls including a plurality of cut-outs positioned below respective ones of the intermediate stacking lugs, and each cut-out having an inclined end portion extending beyond the corresponding intermediate stacking lug to permit an upper like container to be nested down into the first-named container at a third vertically aligned level with the lower stacking feet of the like container being received in respective ones of the cut-outs.

2. The container defined in claim 1, in which at least some of the upper stacking lugs have a V-shaped configuration at their respective upper edges, and the corresponding lower stacking feet have a mating V-shaped configuration at their respective lower edges for causing the lower stacking feet of a like container to be retained on the upper stacking lugs.

3. The container defined in claim 1, in which at least some of the intermediate stacking lugs have a V-shaped configuration at their respective edges, and the corresponding lower stacking feet have a mating V-shaped configuration at their respective lower edges for causing the lower stacking feet of a like container to be retained on the intermediate stacking lugs.

4. The container defined in claim 1, in which at least some of the lower stacking feet have respective outer side sections extending downwardly from the respective lower edges thereof to maintain the stacking feet on the stacking lugs of a like container so as to prevent mutual sidewise motion between the two containers.

* * * * *